United States Patent [19]

Eriksson et al.

[11] Patent Number: 4,890,550

[45] Date of Patent: Jan. 2, 1990

[54] APPARATUS FOR TREATING FIBRE MATERIAL CONTAINING LIQUID

[75] Inventors: Sture Eriksson, Karlstad; Ann-Sofi Jönsson; Bengt Jönsson, both of Genarp, all of Sweden

[73] Assignee: Kamyr Aktiebolag, Karlstad, Sweden

[21] Appl. No.: 267,130

[22] PCT Filed: May 27, 1987

[86] PCT No.: PCT/SE87/00263

§ 371 Date: Oct. 28, 1988

§ 102(e) Date: Oct. 28, 1988

[87] PCT Pub. No.: WO87/07662

PCT Pub. Date: Dec. 17, 1987

[30] Foreign Application Priority Data

Jun. 3, 1986 [SE] Sweden ..... 8602500

[51] Int. Cl.[4] ..... D21C 1/02

[52] U.S. Cl. ..... 100/37; 8/156; 68/45; 68/158; 68/181 R; 100/118; 100/154; 162/60; 210/400

[58] Field of Search ..... 8/156; 68/45, 158, 181 R; 100/37, 118, 119, 120, 151, 152, 154; 162/60; 210/400, 783

[56] References Cited

U.S. PATENT DOCUMENTS

| | | | |
|---|---|---|---|
| 3,469,704 | 9/1969 | Sepall . | |
| 3,938,206 | 2/1976 | Stranger-Johannessen | 8/156 |
| 4,265,171 | 5/1981 | Busse et al. | 100/118 |
| 4,292,123 | 9/1981 | Lintunen et al. | 8/156 X |
| 4,769,986 | 9/1988 | Kokkonen et al. | 8/156 X |

FOREIGN PATENT DOCUMENTS

| | | | |
|---|---|---|---|
| 7308310-7 | 11/1975 | Sweden . | |
| 7204194-0 | 2/1977 | Sweden . | |
| 227803 | 10/1943 | Switzerland | 210/400 |

*Primary Examiner*—Philip R. Coe

*Attorney, Agent, or Firm*—Nixon & Vanderhyde

[57] ABSTRACT

An apparatus for treating fibre material containing liquid, comprising two rotating drums (2, 3), an endless driven belt (17) pervious to liquid and gas and extending between and passing around the surfaces (8, 9) of the drums, a feeding device (10) for the supply and a discharging device (13) for the removal of the fibre material, at least one container for collecting liquid, the liquid being displaced from the fibre material through the endless driven belt (17), a continuous wall (18) impervious to liquid and gas and extending along a main part of and at a distance from the belt (17) from the feeding device (10) to the discharging device (13) in such a manenr that a continuous space (19) is defined for the fibre material between said wall (18) and the belt (17), and at least a part of the space (19), seen in the direction of movement of the belt (17), forms one or more treating zones where liquid is displaced from the fibre web through the movable belt (17) to one or more containers. According to the present invention the distance between belt (17) and wall (18) is about 5–100 mm, preferably about 10–50 mm, and is chosen depending primarily on the fibre concentration of the fibre material so that the fibre material is moved by the moving belt (17) in the form of a fibre web substantially continuous in all directions through said space (19) in sliding contact with the wall (18) with substantially no relative movement between the belt (17) and fibre web or layer thereof.

16 Claims, 2 Drawing Sheets

APPARATUS FOR TREATING FIBRE MATERIAL CONTAINING LIQUID

The present invention relates to an apparatus for treating fibre material containing liquid, said apparatus comprising, at least two drums rotatably journalled on horizontal shafts in a stand, an endless driven belt pervious to liquid and gas and extending between and passing around the cylindrical surfaces of the drums, a feeding means for the supply and a discharging means for the removal of the fibre material, at least one collecting container for collecting liquid and if applicable gas, the liquid and gas being displaced from the fibre material through the endless, driven belt, a continuous wall means impervious to liquid and gas and extending along a main part of and at a distance from the endless, moving belt from the feeding means to the discharging means in such a manner that a continuous space is defined for the liquid containing fibre material between said wall means and the endless, moving belt, and at least a part of the space, seen in the direction of movement of the belt, forms one or more treating zones where liquid and gas if any are displaced from the fibre web through the movable belt to one or more collecting containers.

Various types of apparatus for treating fibre material containing liquid in the form of fibre suspensions are known. They are of a more or less practical nature, and the following references are mentioned as being representative.

FI No. 67892 describes a special fourdrinier wire washing apparatus for washing cellulose pulp in two or more steps, the wire and the fibre web produced thereon being moved through the washing liquid. The washing liquid flows through the fibre web and the wire, the liquid in the fibre web being displaced.

SE No. 157267 describes a means for filtering suspensions such as waste water from the paper industry and comprises an endless screening belt introduced from above into a container filled with the suspension and passing several suction boxes and a rotating screening drum. Before the screening belt is lowered into the suspension a preliminary filter layer is formed thereon.

U.S. Pat. No. 4,014,736 describes a fourdrinier wire washing apparatus having a plurality of suction boxes arranged on the lower side of the upper, horizontal part of a wire running around two rollers spaced apart. In such a washing apparatus of the fourdrinier wire type, only the upper horizontal part of the wire can be utilized for washing a fibre web formed thereon. Considerable force is required to drive the wire and overcome the friction between wire and suction-box lid. The considerable tensile stresses thus occurring in the wire, limit its length since the tensile stress increases with the length of the contact area between wire and suction-box lid.

SE No. 8306658-9 proposes a solution to this problem of tensile strength by replacing the wire by a perforated steel strip. However, the washing result is still limited since the suction effect cannot be increased in view of the resultant increased friction between steel strip and suction-box lid. This reference therefore proposes arranging a special belt pervious to liquid arranged in conjunction with one of the rollers around which the steel strip passes, this special belt running around rollers and cooperating with the steel strip to press liquid out of the fibre web passing therebetween, thus achieving a higher dry solids content in the fibre web produced.

U.S. Pat. No. 3,878,698 (corresponding to SE No. 349340)describes a washing press for washing a fibre web formed on a rotating perforated drum and washed in a washing zone. A liquid chamber being under pressure is arranged on the outside of a cover inside which the fibre web travels. Within the region of the liquid chamber, the cover is provided with a plurality of cylindrical liquid flow channels emerging on the inside of the cover and being in direct contact with the fibre web.

SE No. 378433 describes an apparatus for continuously separating a suspension liquid from a fibre suspension which is conducted through a fibre separating space defined by the casing of a rotating drum and the casing of a vessel surrounding the drum. The radial distance between the surfaces of the drum and the vessel decreases in the direction of rotation of the drum. A restriction plate is arranged at the outlet from the liquid separating area to the fibre separating area, this plate being radially adjustable to the drum by means of an oscillatory movement. The liquid separation is adjusted by altering the radial distance of the liquid separating space between said two surfaces with the aid of the restriction plate and simultaneous adjusting the speed of the drum and the flow of the filtrate. The alteration of said radial distance is thus limited to an extremely small section of the liquid separating area, this section being determined by the length of the pivotable restriction plate.

U.S. Pat. No. 3,616,660 (corresponding to SE No. 318183) describes an arrangement for washing a continuously moving web produced from a cellulosa fibre suspension between a rotating drum and a wire, two perforated pressing elements being arranged to exert pressure on the wire in the direction of the drum with the aid of pressing means. The pressing elements are joined by a hinge and each is provided with a cover. One of the pressing elements is pivotable within a spent liquor separation zone and forms a space between drum and wire narrowing in the direction of feed. The shape of this space can be altered with the aid of the pressing means. Application of a suitable pressure on the pivotable pressing element by the pressing means causes gradually increasing dry solids content in the fibre web.

SE No. 391356 relates to an apparatus for treating a fibre suspension in which two unperforated pressing screens extend between an outer vessel wall and the drum, each pressing screen being pivotably journalled at one end enabling it to be swung between the drum and the vessel wall. A narrowing space is thus formed and maintained between pressing screen and drum, movement of the pressing screen being effected by an actuating member. Each screen is provided with a plurality of reinforcing ribs.

SE No. 7802937-8 describes a washing apparatus for washing cellulose fibres in which a perforated drum rotates in a container to form a fibre web from a fibre suspension supplied to the container from a head box. A thin compressing screen is arranged in the container to exert a compressive force on the fibre web, with the aid of control means, both in a forming zone and in a following compression zone. The screen can be bent at a line located at the transition between forming and compression zones. The screen may either be provided with reinforcing strips cut at said lines, or it may be in two parts hinged at said line.

The pressing means in the washing apparatus according to the above-mentioned patent specifications permit only limited compression of the fibre web and only small quantities of liquid can therefore be displaced from the fibre web. To achieve an acceptable washing result, several such arrangements must be provided in series with each other and such an installation will therefore require at least as much space as a fourdrinier wire washing apparatus of the type described above.

U.S. Pat. No. 3,469,704 discloses a slurry washing apparatus comprising an elongated vessel of rectangular cross-section. Liquid impervious rollers are disposed at a distance above each other the lower one of which being located at the bottom portion of the vessel. Perforated inner wall sections extend between the rollers and define a suction chamber. An endless foraminous belt travels around the rollers and along the inner wall sections. Liquid jackets extend over opposite perforated walls of the vessel to supply wash liquid. Slurry fed into the vessel is washed by wash liquid while a filter cake is deposited on the travelling belt by the action of the suction in the inner chamber. Since the vessel walls are located at a considerable distance from the foraminous belt the filter cake deposited will not fill the entire space therebetween. Most part of this space will therefore contain slurry and added wash liquid so that a layer of diluted slurry is fed outside the filter cake from the inlet to outlet. The apparatus therefore operates at low washing effect and requires considerable amounts of wash liquid.

The object of the present invention is to provide an improved apparatus for treating fibre material containing liquid, such as dewatering and washing a fibre web formed of the liquid containing fibre material, said apparatus operating with satisfactorily high capacity and giving considerably better treating results than known apparatus or installations having corresponding capacity, while at the same time requiring less space than said known apparatus and installations and also being easily adaptable to various different operating conditions and types of treatments. The improved treating result includes considerably increased dry solids content and the use of a very low dilution factor in order to achieve the desired degree of purity.

According to the invention this object is achieved in that the distance between the movable belt and the wall means is about 5–100 mm, preferably about 10–50 mm, and is chosen depending primarily on the fibre concentration of the fibre material so that the fibre material is moved by the moving belt in the form of a fibre web substantially continuous in all directions through said space in sliding contact with the wall means with substantially no relative movement between the endless, moving belt and the fibre web or layer thereof.

If said distance between the movable belt and the wall means is too large, one or more liquid-containing fibre layers will be formed nearest to the stationary wall means and will remain stationary in relation to the movable belt, or at least move more slowly than the movable belt thus preventing the desired treatment of the liquid-containing fibre material. In general, therefore, the lower the fibre concentration in the fibre suspension being supplied, the narrower must the space be for a given belt speed to enable the desired capacity.

According to a preferred embodiment of the invention the wall means extends along and surrounding a main part of the moving belt, such as from about 60%, preferably from about 80%, up to an upper limit, generally about 90–95%, to provide a necessary area of the movable belt exposed between the feeding means and discharging means for the fibre material, said exposed area being used for spray-cleaning the moving belt.

In order to utilize the maximum treating effect, the casings of both drums and the two support elements are pervious to liquid and gas, the total space thus forming one or more treating zones where treating agent is displaced from the fibre web through the movable belt to a plurality of collecting vessels. It is advisable for the distance between the movable belt and the wall means to decrease in the direction of movement of the belt, at least within a first longitudinal section of the space, thus providing a first treating zone in which the fibre web is subjected to increasing mechanical pressure so that liquid and any gas are displaced from the fibre web through the movable belt to a collecting vessel.

To allow treatment of the fibre material with a treating agent, either liquid or gaseous, the apparatus is provided in another preferred embodiment with one or more treating agent liquid dischargers, each having at least one transverse row of flow channels, said dischargers being arranged in the wall means to supply treating agent to the fibre web passing by on the movable belt, in order to form a corresponding number of successive treating zones in which the fibre web is subjected to a hydraulic pressure forcing the liquid or gas out of the web, through the movable belt to a collecting vessel for each treating zones. If several dischargers are used, the treating agent is advantageously conducted in counterflow to the direction of movement of the fibre web from a treating zone located downstream to a treating zone located next upstream.

Due to the specific design of the apparatus it can advantageously be used for many different types of treatment of a liquid containing fibre material. The treatment may comprise, for instance, simple dewatering of material containing cellulose, e.g. cellulose pulp and peat, i.e. without the addition of a treating agent, or washing, optionally combined with final dewatering of material containing cellulose, e.g. cellulose pulp, in which case the treating agent is water. The treatment may also consist of various types of chemical treatment of a fibre material with a liquid or gaseous treating agent, e.g. displacement bleaching or dynamic bleaching of cellulose pulp, where the treating agent consists of sodium hydroxide or chlorine dioxide. Treatments using gaseous bleaching agents such as chlorine can also be performed. Various combinations of treatments of the above type may also be carried out in one and the same apparatus, or in two or more apparatus connected in series.

The invention will be described further in the following, with reference to the accompanying drawings.

Figure 1:
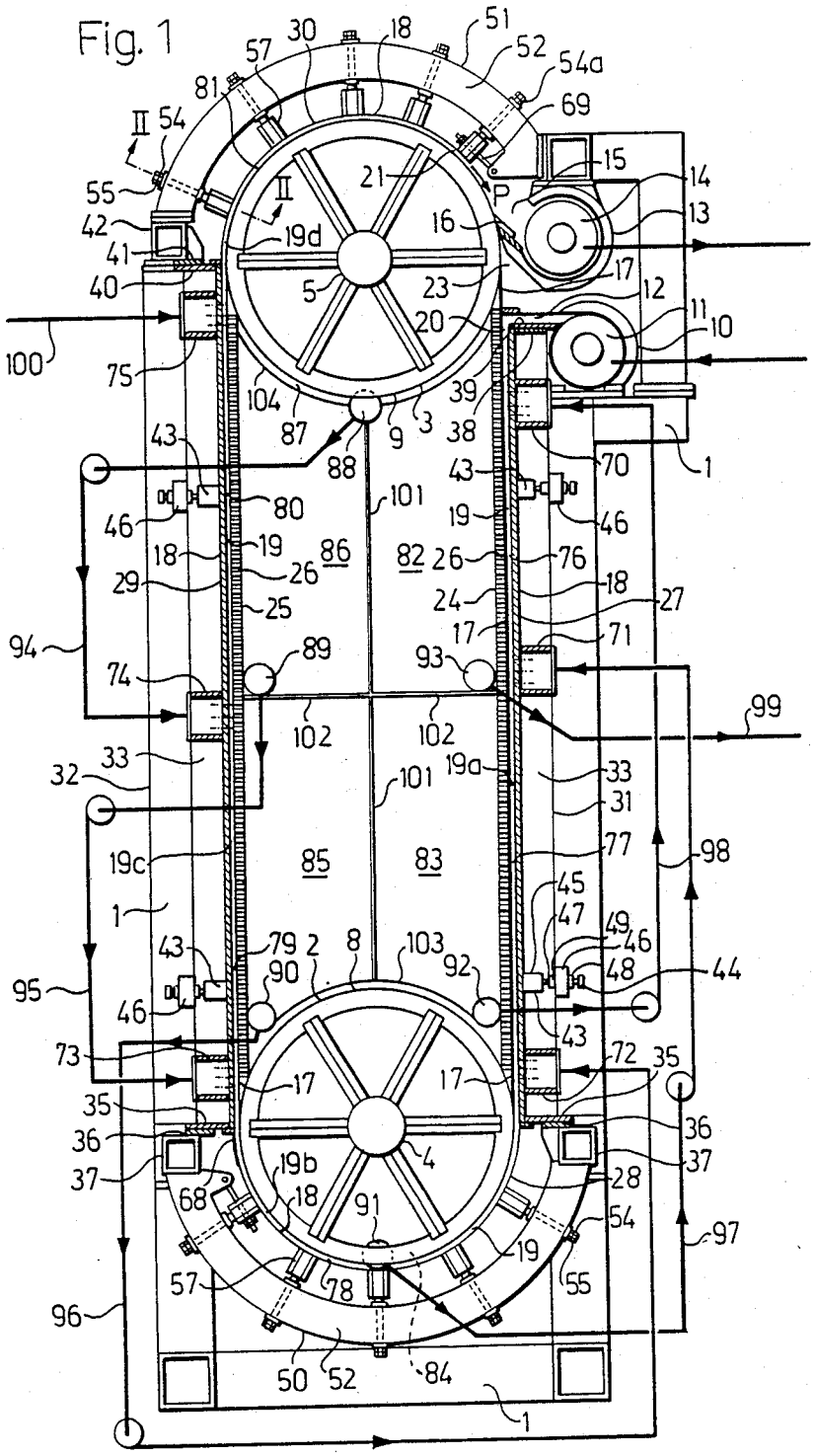
FIG. 1 is a sectional side elevation of an apparatus for treating a fibre suspension according to a preferred embodiment of the invention shown schematically, side sections having been removed for the sake of illustration.

The apparatus schematically shown in the drawings has been specifically designed for treating fibre material with a liquid treating agent, particularly washing cellulose pulp with water. However, the apparatus can be used for treating fibre material with a gaseous treating subjected to hydraulic pressure in all the treating zones, so that liquid is displaced through the fibre web. Each liquid discharger is provided with at least one preferably a plurality of transverse rows of liquid flow channels. Furthermore, in the embodiment shown, the distance between belt 17 and the curved plates 28, 30 decreases in the direction of movement of the belt within the two treating zones 78 and 81. The fibre web is thus subjected to increasing mechanical pressure in addition to hydraulic pressure so that additional liquid is pressed out of the fibre web corresponding to the decrease in volume of the adjustable space 19 for the fibre material. Each treating zone 76–81 also comprises a collection container 82–87 to collect treating agent being displaced and, as the case may be, pressed out of the web. The treating agent is conducted in accordance with the counterflow principle via flow means in the form of outlets 88–92 and pipes 94–98 provided with pumps, from the last collecting container 87 to the first collecting container 82 after having passed the various liquid dischargers, treating zones and collecting containers. Spent treating agent is then removed from the first collecting container 82 via an outlet 93 and conveyed via a pipe 99 to a tank (not shown). Fresh treating agent is supplied to the last liquid discharger 75 through a pipe 100. As shown in FIG. 1, four of the collecting containers are arranged in the space between drums 2, 3 and support elements 24, 25, the latter forming the side walls of the containers together with an opposing vertical partition 101. A horizontal partition 102 forms the bottom of the two uppermost containers 82, 86 while a curved plate 103 located immediately above the lower drum 2 forms the bottom of the two lowermost containers 83, 85. The other two collecting containers are located in the drums 2, 3, the bottom of the lowermost container 84 being formed by the inside of the cylindrical surface 8 of the drum 2, while the bottom of the uppermost container is formed by a curved plate 104 placed below drum 3 at a small distance therefrom.

The inner surfaces of plates 27–30, in contact with the fibre web moving together with the endless belt 17, are smooth and polished and have low friction coefficient. The resistance of the fibre web against the inner surfaces of the plates is further reduced by the thin film of liquid produced by a portion of the treating liquid continuously being supplied under pressure from the liquid dischargers.

The wall means 18, stationary during operation, extends along and surrounding a main portion of the movable belt 17, generally from about 60%, preferably from about 80%, up to an upper limit generally about 90–95%, to provide a necessary area of the movable belt exposed between the feeding means and discharging means for the fibre material. The exposed area at the space 23 can be used for spray-cleaning the belt, as mentioned above.

The feeding and discharging means may be placed at other points than those shown, although the embodiment according to FIG. 1 is the preferred one since the fibre web can be more easily removed from a curved surface than from a straight one, (in the case shown the fibre web strives to straighten itself out).

According to an alternative embodiment (not shown) the apparatus is arranged horizontally with the drums substantially in the same horizontal plane. This may be more advantageous in some cases from the point of view of servicing and adjustment. According to a further embodiment, the apparatus has three or more drums of the type described or some other type. However, two drums according to the embodiment shown are preferred since this provides sufficiently high capacity.

The apparatus according to the invention offers numerous significant advantages. Whereas a fourdrinier wire washer is only able to utilize the upper horizontal length of the belt for treating the fibre web, substantially all the belt (up to 95% thereof) is used to form an efficient treating area in the apparatus according to the invention. Due to pressure above atmospheric the pressure difference above the pulp bed or fibre web can easily be increased, e.g. more than doubled, enabling the effective belt area to be substantially halved for a treating result determined. The apparatus can be run without pressure below atmospheric having to be set in the collecting containers which, besides reduced costs, also allow a higher temperature to e used for the treating liquid since the boiling point is not influenced by pressure below atmospheric. The higher temperature lowers viscosity and thus through-flow resistance. A fourdrinier wire of the type described in the introduction and used in practice has a length of about 30 m and a width of about 6 m. The total belt area is 420 $m^2$, of which only 180 $m^2$ is effective belt area. The apparatus according to the invention has the same capacity with a total belt area of only 55 $m^2$ and its largest dimension, i.e. its height in the embodiment shown, is only 8.3 m (measured between the turning points of the belt on the drums), with a drum diameter of 2 m and belt width of only 3 m.

It is understood from the above description that the expression "that the distance between the movable belt 17 and the wall means is about 5–100 mm" means that the distance may be constant or it may be varied in the longitudinal direction of the belt. The distance is constant in the transverse direction for each value thereof in a treating zone or part thereof.

We claim:

1. An apparatus for treating fibre material containing liquid, comprising at least two drums (2, 3) rotatably journalled on horizontal shafts (4, 5) in a stand (1), an endless driven belt (17) pervious to liquid and gas and extending between and passing around the cylindrical surfaces (8, 9) of the drums, a feeding means (10) for the supply and a discharging means (13) for the removal of the fibre material, at least one collecting container for collecting liquid and if applicable gas, the liquid and gas being displaced from the fibre material through the endless driven belt (17), a continuous wall means (18) impervious to liquid and gas and extending along a main part of and at a distance from the endless, moving belt (17) from the feeding means (10) to the discharging means (13) in such a manner that a continuous space (19) is defined for the liquid containing fibre material between said wall means (18) and the endless, moving belt (17), and at least a part of the space (19), seen in the direction of movement of the belt (17), forms one or more treating zones where liquid and gas if any are displaced from the fibre web through the movable belt (17) to one or more collecting containers, characterized in that the distance between the movable belt (17) and the wall means (18) is selected so that the fibre material is moved by the moving belt (17) in the form of a fibre web substantially continuously in all direction through said space (19) in sliding contact with the wall means (18) with substantially no relative movement between the endless, moving belt (17) and the fibre web or a layer thereof, said distance being between about 5–100 mm, depending upon fibre concentration.

2. An apparatus according to claim 1, characterized in that the wall means (18) extends along and surrounding about 60–95% of the moving belt, to provide a necessary area of the movable belt (17) exposed between the feeding means (10) and discharging means (13) for the fibre material, said exposed area being used for spray-cleaning the moving belt (17).

3. An apparatus according to claim 1 or 2, characterized in that two parallel, flat support elements (24, 25) are arranged between the cylindrical surfaces (8, 9) of the drums (2, 3) in tangential relation thereto and extending along the movable belt (17) to support said belt, at least one of the support elements being pervious to liquid and gas, and the cylindrical surface of at least one of the drums being pervious to liquid and gas.

4. An apparatus according to claim 3, characterized in that the cylindrical surfaces (8, 9) of both drums (2, 3) and the two support elements (24, 25) are pervious to liquid and gas, the continuous space (19) forming one or more treating zones (76–81) in which treating agent is displaced from the fibre web through the movable belt (17) to a plurality of collecting containers (82–87).

5. An apparatus according to claim 3, characterized in that the distance between the movable belt (17) and the wall means (18) decreases in the direction of movement of the belt (17), at least within a first longitudinal section of the space (19), providing a first treating zone (78 or 81) in which the fibre web is subjected to increasing mechanical pressure so that liquid and any gas are displaced from the fibre web through the movable belt (17) to a collecting container (84 or 87).

6. An apparatus according to claim 5, characterized in that said first treating zone is located within the area of one of the drums (2, 3).

7. An apparatus according to claim 5, characterized in that the distance between the movable belt (17) and the wall means (18) decreases in the direction of movement of the belt (17) within first and second longitudinal sections of the space (19), providing first and second treating zones (78, 81) in which the fibre web is subjected to increasing mechanical pressure displacing liquid and any gas from the fibre web through the movable belt (17) to first and second collecting containers (84, 87).

8. An apparatus according to claim 7, characterized in that said first and second treating zones are located within the area of the drums (2, 3).

9. An apparatus according to claim 1, characterized in that one or more treating-agent dischargers (70–75), each having at least one transverse row of flow channels, are arranged in the wall means (18) to supply treating agent to the fibre web passing together with the movable belt (17) in order to form a corresponding number of successive treating zones (76–81) in which the fibre web is subjected to a hydraulic pressure displacing the liquid or gas from the web, through the movable belt (17) to a collecting container (28–87) for each treating zone.

10. An apparatus according to claim 9, characterized in that it comprises a plurality of treating-agent dischargers (70–75), and that means (88–92, 94–98) are disposed to conduct the treating agent in counterflow with respect to the direction of movement of the fibre web from a treating zone located downstream to a treating zone located upstream.

11. An apparatus according to claim 1, characterized in that the wall means (18) consists of at least one plate carried by outer support means (31, 32, 50, 51).

12. An apparatus according to claim 11, characterized in that it comprises adjusting means (43, 54) for adjusting the distance of the wall means (18) in relation to the movable belt (17).

13. An apparatus according to claim 12, characterized in that said outer support means comprises two straight beam units (31, 32) disposed opposite each other and movable by means of first adjusting means (43), and two arc-formed beam units (50, 51) located opposed each other and secured to the stand (1), the beam units carrying a plurality of second adjustment means (54) each intended to influence its own section of a curved, flexible plate (28, 30) to adjust its distance to the movable belt (17), and that each of said second adjustment means (54) comprises a connecting element (57) which is rigidly connected to the outer surface of the plates (28, 30) facing away from the drum (2, 3) in the relevant section of the plates, and at least one setting device (55, 56) connected to said connecting element (57) and arranged to be detachable anchored to the beam unit (50, 51) so as to retain the section of the plate (28, 30), with the aid of connecting element (57), in a predetermined, set distance in relation to the movable belt (17), the setting device (55, 56), once its anchorage has been released, being arranged to influence the plate (28, 30) via said connecting element (57) to move the section of the plate (28, 30) radially outwards or inwards in relation to the belt (17).

14. An apparatus according to claim 2, characterized in that the drums (2, 3) are arranged one above the other so that the movable belt (17) is extended vertically between the drums (2, 3).

15. In a method of treating a fibre material containing liquid, the steps of:

providing at least two drums rotatably journalled on horizontal shafts in a stand, and including an endless drive belt pervious to liquid and gas extending between and passing around cylindrical surfaces of the drums, and a continuous wall means impervious to liquid and gas and extending along a main part of and spaced from the endless moving belt; and adjusting the distance between the movable belt and the wall means to between about 50–100 mm, dependent upon the fibre concentration of the fibre material being treated, so that the fibre material is moved by the moving belt in the form of a fibre web substantially continuously in all directions in sliding contact with the wall means, with substantially no relative movement between the endless moving belt and the fibre web or a layer thereof.

16. A method as recited in claim 15 comprising the further step of adjusting the distance between the movable belt and the wall means so that it decreases in the direction of movement of the belt at one point in the space between the belt and the wall means, so as to displace liquid and gas from the fibre web through the belt to collecting containers.

* * * * * agent, in which case some minor modifications may be required. For the sake of simplicity the apparatus is described in conjunction with a liquid treating agent, but it should be understood that the term "liquid" may be replaced or supplemented by "gas". When gas is used as treating agent it is advisable for the apparatus to be covered by a hood.

With reference to FIG. 1 it is shown therein an apparatus extending in vertical direction for treating a fibre material. The apparatus comprises a stand 1 and lower and upper drums 2, 3 located one above the other and spaced apart at a predetermined distance. The shafts 4 and 5 of the drums are rotatably journalled in the stand 1. The drums 2, 3 are closed at their ends by gables 6, 7 (FIG. 2 and have cylindrical, liquid-pervious surfaces 8, 9, respectively, each comprising a rigid perforated plate and one or more wires (not shown) surrounding the plate. The shafts 4, 5 of the two drums are disposed in the same vertical plane and are parallel to each other. In the embodiment shown the drums have the same diameter D. The distance between the cylindrical surfaces of the drum may vary but preferably it lies within the range of from about $0.5 \times D$ to about $3 \times D$.

The apparatus also comprises a feeding means 10 having an elongate feeding screw 11 and inlet channel 12, and a discharging means 13 having a discharging screw 14 and an outlet channel 15 with a scraping blade 16. The feeding and discharging screws 11, 14 are mounted on the stand 1 close to the upper drum 3 and substantially on a level with and parallel to the shaft 5 of the upper drum 3. The feeding screw 11, preferably of the embodiment described in SE No. 8304979-1 (corresponding to U.S. Pat. No. 4,559,104), is disposed below the discharging screw 14 and as close to this as is practically possible.

Figure 2:
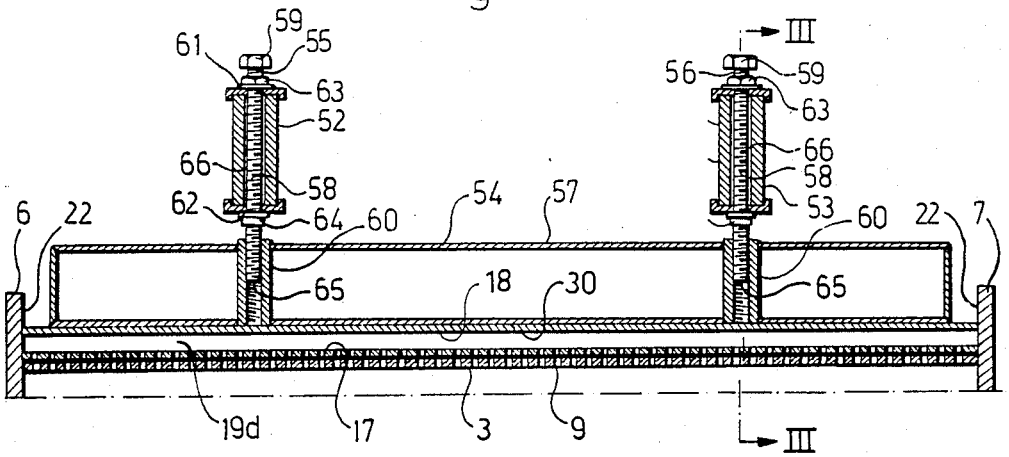
FIG. 2 is a section along the line II—II in FIG. 1 and shows one of the adjustment means in the apparatus.

In accordance with the present invention the apparatus comprises an endless, liquid-pervious movable belt 17 and a continuous liquid-impervious wall means 18 disposed outside the belt 17 and at a predetermined distance therefrom so that a continuous slot-formed space 19 for the fibre material is formed between the outer wall means 18 and inner belt 17. This space communicates directly with the inlet and outlet channels 12, 15 via inlet gap 20 and outlet gap 21. As shown in FIG. 2 the space 19 is closed laterally by extended peripheral portions 22 (FIG. 2) of the gables 6, 7 of the drum and side-plates (not shown extending between the drums 2, 3, the side-plates suitably also closing the large container space located between the drums 2, 3. Placing the feeding screw 11 and the discharging screw 14 adjacent each other ensures that there is only a smaller surface of the belt 17 which does not cooperate with the wall means 18. This space 23 can be used for spraying liquid onto the belt 17 in order to clean it.

The endless belt 17 extends between the drums 2, 3, passes around and in contact with them. It is driven by one or both drums 2, 3 and runs in the direction (clockwise) indicated by the arrow P (shown at the outlet in FIG. 1). The belt 17 may consist of two or more fourdrinier wires, but preferably consists of a flexible steel strip provided with a large number of perforations or slits permitting liquid to be drained from the space 19 for the fibre material, with the least possible resistance. Between the drums 2, 3 the belt 17 runs along straight, inner support elements 24, 25 provided with a large number of drainage holes 26 to allow through the liquid passing through the belt 17 provided with perforations, slits or other apertures.

In order starting from the inlet gap 20 the outer wall means 18 is provided with a first flat (non-curved), rigid plate 27 extending along the support element 24, a first curved, flexible plate 28 extending along the cylindrical surface 28 of the lower drum 2, a second flat (non-curved), rigid plate 29 extending along the support element 25, and a second curved, flexible plate 30 extending along the cylindrical surface 9 of the upper drum 3. The liquid-impervious plates 27–30 are carried by special support means keeping them in desired stationary positions during operation in relation to the movable belt 17. In the embodiment shown the support means comprise two substantially vertical beam units 31, 32 having longitudinal and vertical beams 33. Each beam unit 31, 32 is provided at its lower end with a horizontal sliding plate 35 resting freely on a horizontal, stationary sliding plate 36 secured to a transverse beam 37 of the stand 1. The substantially vertical beam units 31, 32, to which the flat plates 27, 29 are secured, are thus supported by the beams 37 of the stand 1. The beam unit 31 located nearest to the inlet channel 12 is provided at its upper end with a horizontal sliding plate 38 which is supported by the bottom wall 39 of the inlet channel 12. Special sealing means (not shown) may be arranged to seal the joint between the sliding plate 38 and bottom wall 39.

The second beam unit 32 facing away from the feeding means 10 is provided at its upper end with a horizontal sliding plate 40 supported by a horizontal, stationary sliding plate 41 which is secured to a transverse beam 42 of the stand 1. The arrangement with the sliding connections at the lower and upper ends of the beam units 31, 32 permits movement of the beam units 31, 32 in relation to the movable belt 17 enabling the distance between belt and respective plates 27, 29 to be adjusted as desired. The distance can thus be varied within the range of each beam unit 31, 32, increasing, decreasing or remaining constant as seen in the direction of feeding. Each straight section 19*a*, 19*c* of the fibre material space 19 can thus be adjusted to a diverging, converging or constant shape. The beam units 31, 32 are moved with the aid of upper and lower adjustment means 43. In the embodiment shown each adjustment means comprises two setting devices 44 and an elongate, beam-shaped connecting element 45, arranged horizontally, which is secured to the outer surface of the flat plate 27, 29. An elongate support element 46 is secured to the stand 1 and extends parallel to the connecting element 45 at a suitable distance therefrom. Each setting device 44 comprises a setting bolt 47 passing freely through the support element 46, i.e. without thread or friction engagement. The setting bolt 47 is screwed into a tapped hole in the connecting element 45 or, alternatively, into an internally tapped sleeve secured to the connecting element 45. The setting bolt 47 is provided with a locking means to detachably anchor the setting device 43 to the support element 46. The locking means consists of an outer locking nut 48, located outside the support element 46, and an inner, stationary stop 49 which is secured to the setting bolt 47, e.g. by welding, at a suitable distance from its inner end to enable the necessary screw engagement to be utilized by the connecting element 45.

Besides the two straight beam units 31, 32, the support means comprise two lower and upper curved beam units 50, 51 disposed at a suitable distance from the drums 2, 3 and rigidly mounted to the stand 1. Each stationary curved beam unit 50, 51 suitably comprises two substantially C-shaped arc elements 52, 53 (FIG. 2) each arranged stationarily in its own vertical plane and located at the same predetermined distance from the curved plate 28, 30, respectively, thus enclosing these plates. A plurality of adjustment means 54 are distributed uniformly along each arc-shaped beam unit 50, 51. The adjustment means are connected to the curved plates 28, 30 for adjustment of the arc-shaped section **19*b*, 19*d* of the fibre material space 19. The curvature or radii of the plates 28, 30 can thus be altered and set individually in several areas by actuating an adjustment means 54 for each area. In the embodiments shown, each adjustment means 54 at such an adjustable area comprises two setting devices 55, 56 and an elongate, shape-rigid connecting element in the form of a horizontal beam 57 secured to the outside of the plate 28 and 30, respectively, and extending parallel to the drum shaft 4 and 5, respectively, between the side edges of the plate 28, 30. Each setting device 55, 56 comprises a setting bolt 58 directed substantially radially with respect to the drum 2, 3, the heads 59 of the two laterally-disposed setting bolts being easily accessible outside the arc elements 52, 53 and extending freely therethrough, i.e. without thread or friction engagement. The setting bolts 58 are screwed into internally tapped sleeves 60 secured in the connecting beam 57. Each setting bolt 58 is provided with outer and inner washers 61, 62 and comprises a locking means for detachably anchoring of the adjustment means 54 to the arc element 52, 53. The locking means consists of a locking nut 63 located outside the outer washer 61, and a stationary shoulder 64. The washers 61, 62 abut the outer and inner sides of the arc element 52, 53 to provide support thereto. The stationary shoulder 64 is secured, e.g. by welding, to a front portion of the setting bolt 58 located between the arc element 52, 53 and the connecting beam 57, at a suitable distance from the inner end 65 of the setting bolt 58, said distance being suitably at least as great as the depth of the hole in the sleeve 60 so that the full screw engagement can be utilized. Each arc element 52, 53 has a radial through-opening 66 for each setting bolt 58, the opening extending sufficiently far in the longitudinal direction of the arc element 52, 53 to enable the setting bolt 58 to move freely clockwise or counterclockwise a required distance in the longitudinal direction of the arc element depending on the adjustment of the plate 28, 30 to be performed within one or more areas. Such a free movement is thus only possible when the setting bolts 58 are released or loosened from the arc elements 52, 53 by loosening the nuts 63 and screwing them in a direction away from the shoulder 64. In the embodiment shown, the radial through-openings 66 are obtained by each arc element 52, 53 being formed by two relatively thick arc-shaped plates disposed at a predetermined distance from each other and secured together by a plurality of outer and inner cross-pieces, for instance, (not shown). Said predetermined distance is somewhat larger than the diameter of the setting bolts 58** in order to avoid friction engagement.

Figure 3:
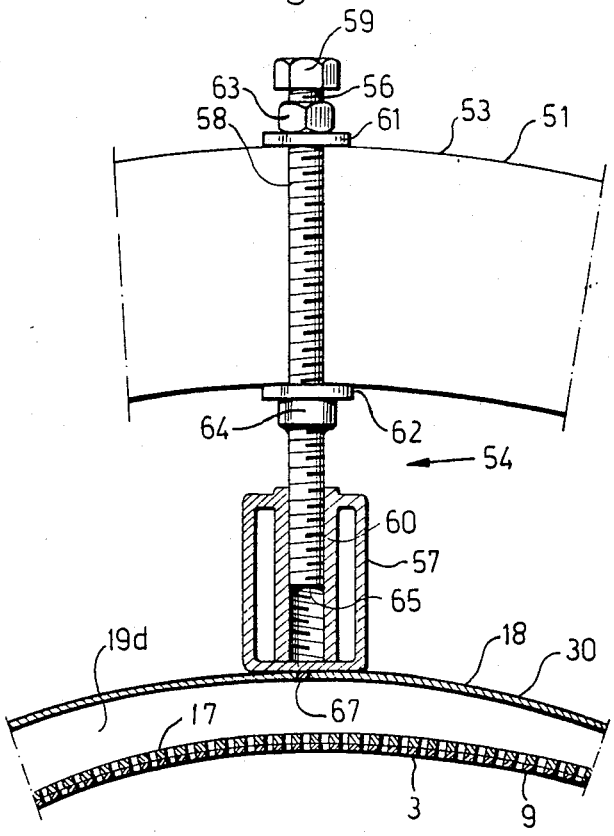
FIG. 3 is a cross section of the adjustment means along the line III—III in FIG. 2.

To ensure that the desired radius of plate 28, 30 is maintained also in the connecting beam 57 of each area, this beam is connected to the plate 28, 30 only along a straight line which suitably corresponds to the centre line of the inner surface of the connecting beam 57, a suitable number of spot welds 67 (FIG. 3) being effected along this line in order to make a strong joint between the plate 28, 30 and connecting beam 57. Thus also the portions of the plate 28, 30 facing said inner surface and on each side of the line of spot welds 67 will be free to bend upon radial displacement of the plate 28, 30 in the direction towards or away from the cylindrical surface 8, 9 of the drum.

Said first curved plate 28 is secured by one end to the sliding plate 35, while its other end is in sliding contact with a small lip-shaped support plate 68. Thus, the support plate 68 constitutes a small portion of the wall means 18 and is secured to and extends downwardly from the sliding plate 35. The support plate 68 is sufficiently thick to withstand the liquid pressure in the fibre material space 19. A support may possibly be arranged outside the support plate 68 if desired. Furthermore, the free end of the curved plate 28 can be secured to the support plate 68 by suitable screw means (not shown) extending through oblong longitudinal openings in the support plate 68. Unscrewing the screw means will release the end of the curved plate 28, enabling it to slide freely along the supper plate 68, overlapping this, to compensate for alterations in the radius of the curved plate 28 when the distance between the curved plate 28 and belt 17 is set.

The second curved plate 30 is secured by its one end to the sliding plate 40, while its other end, located downstream, is supported by the downstream adjustment means **54*a*, which determines the size of the outlet gap 21. A suitable pulling means 69 is mounted between each arc element 52, 53 and the connecting beam 57 of the furthest downstream adjustment means 54*a*. A tensile force is effected in the plate 30 by means of the pulling means 69 and this force is utilized to assist in moving the plate 30 towards the outlet channel 15 to compensate for the reduced radius of the plate 30 in the areas of the upper drum 3 when the plate 30 is adjusted using some or all of the adjustment means 54. The opening, small or large, between the outlet channel 15 and plate 30** before its downstream end can be closed by means of an adjustable screen or the like (not shown).

The adjustment means 43, 54 allow the fibre material space 19 to be adjusted as desired to achieve optimal treating results in each case of operation. Adjustment can be effected along the entire length of the fibre material space 19 starting from its inlet gap 20, directly communicating with the inlet channel 12, to the outlet gap 21 at the downstream end of the upper curved plate 30. If the distance between belt 17 and plates 28, 30 is to be altered within the curved treating zones, the adjustment means 54 are loosened from the arc elements 52, 53 leaving the plates 28, 30 free to move both radially in relation to respective drums 2, 3 and in the direction of their curvature. The plates 28, 30 designed and supported in the manner described, are thus also arranged to slide in sealing engagement with the insides of the gables 6, 7 of the drums. The plates 28, 30 are of uniform thickness and sufficiently strong to withstand inner pressure from the fibre material at the points between two adjacent connecting elements 57 without permanent deformation, while having sufficient elasticity to assume uniform curvature with larger or smaller radius when affected by the adjustment means 54. The flat plates 27, 29 are also arranged to slide in sealing engagement with the inner surfaces of the side closures (not shown) extending between the drums 2, 3.

In the embodiments shown there are six liquid dischargers 70–75 distributed along the wall means 18 to supply liquid to the fibre web passing together with the belt 17, thus forming a corresponding number of consecutive treating zones 76–81. The fibre web is thus